United States Patent [19]

Chew, II

[11] Patent Number: 4,899,496

[45] Date of Patent: Feb. 13, 1990

[54] PORTABLE CHILD ENCLOSURE

[76] Inventor: Bonnie G. Chew, II, 909 Euclid Ave., Birmingham, Ala. 35213

[21] Appl. No.: 114,200

[22] Filed: Oct. 29, 1987

[51] Int. Cl.[4] ..... A47D 13/06

[52] U.S. Cl. ..... 5/98 R; 5/99 B; 5/99 C

[58] Field of Search ..... 5/98, 99

[56] References Cited

U.S. PATENT DOCUMENTS

| | | | |
|---|---|---|---|
| 1,020,998 | 3/1912 | Mattes . | |
| 2,464,866 | 3/1949 | Holtz . | |
| 2,491,036 | 12/1949 | Dodge . | |
| 2,590,315 | 3/1952 | Hawley, Jr. . | |
| 2,681,456 | 6/1954 | Schiemer . | |
| 2,784,420 | 3/1957 | Moltane . | |
| 2,922,653 | 1/1960 | O'Brien . | |
| 3,050,745 | 8/1962 | Tabbert . | |
| 3,105,505 | 10/1963 | Maybee . | |
| 3,165,760 | 1/1965 | Abajian . | |
| 3,176,428 | 4/1965 | Slingluff . | |
| 3,206,772 | 9/1965 | Sarasin . | |
| 3,424,178 | 1/1969 | Yazaki . | |
| 3,532,369 | 10/1970 | Reilly . | |
| 3,763,506 | 10/1973 | Szego | 5/99 |
| 3,924,280 | 12/1975 | Vaiano . | |
| 4,070,716 | 1/1978 | Satt et al. . | |
| 4,202,065 | 5/1980 | Sullivan | 5/99 C |
| 4,538,309 | 9/1985 | Gunter . | |
| 4,688,280 | 8/1987 | Kohus et al. | 5/99 R |
| 4,703,525 | 11/1987 | Shamie | 5/99 C X |
| 4,739,527 | 4/1988 | Kohus et al. | 5/99 R |
| 4,750,223 | 6/1988 | D'Arcy et al. | 5/99 B |

FOREIGN PATENT DOCUMENTS

| | | | |
|---|---|---|---|
| 418037 | 8/1925 | Fed. Rep. of Germany . | |
| 1249598 | 9/1967 | Fed. Rep. of Germany . | |
| 3634136 | 4/1987 | Fed. Rep. of Germany | 5/99 C |
| 802824 | 6/1936 | France . | |
| 1557841 | 1/1969 | France | 5/99 R |
| 2006297A | 5/1979 | United Kingdom . | |

*Primary Examiner*—David A. Scherbel
*Assistant Examiner*—Creighton Smith
*Attorney, Agent, or Firm*—Staas & Halsey

[57] ABSTRACT

A child enclosure includes J-shaped frame base members that extend beyond the footprint of a fabric compartment preventing tipping. The fabric compartment of the enclosure closely fits the upright corner posts using tubes allowing a side support rod to be inserted in the upper side rails of the enclosure preventing downward side flex. The close fitting of the post tubes provides increased support to the side rails. The fabric compartment corners are covered at the top edge by a fabric panel to prevent a child from standing up in the corner to and provide increased strength to the side panels enhancing the side panel flex prevention feature. A rectangular frame is stabilized along the short axis by a separator support that prevents the short axis from collapsing. The rectangular frame also includes a U-shaped end piece that provides further support to the compartment along the end.

2 Claims, 3 Drawing Sheets

PORTABLE CHILD ENCLOSURE

CROSS-REFERENCE TO RELATED DISCLOSURES

This application is related to U.S. Pat. No. 4,538,309 and to U.S. application Ser. No. 771,046, both incorporated by reference herein.

BACKGROUND OF THE INVENTION

This invention relates to a portable child enclosure and, more particularly, to a child enclosure with a disassemblable frame and with enhanced safety features.

Conventional child enclosures such as playpens and baby cribs include features which allow a child of advanced development to create a possibly hazardous situation. These features include flexible fabric sides which the advanced child can bend downward, allowing the child to climb and fall out of the enclosure. Even when side support rails are provided in the top edge of such enclosures the side support rails are sufficiently separated from the upright supports by fabric sleeves that excessive side flex can still occur. The supports for the playpen frame are aligned with the end supports for the fabric compartment allowing a large child to tilt the playpen over on its side. A large child can also stand in the corner of the playpen and rock the playpen around.

SUMMARY OF THE INVENTION

It is an object of the present invention to provide a child enclosure which resists tipping when an active child moves back and forth.

It is another object of the present invention to prevent a child from climbing over the side of the enclosure by flexing the fabric sidewalls of the playpen downward.

It is an additional object of the present invention to prevent a child from standing in the corner, thereby reducing the child's ability to climb out of or rock the enclosure at the corner.

It is a further object of the present invention to stabilize the X-shaped ends of a rectangular support structure to enhance the stability of a rectangular enclosure.

It is a still additional object of the present invention to prevent the enclosure from sliding around on a hard surfaced floor when an active child moves about in the enclosure.

The above objects can be attained by a child enclosure with J-shaped frame base members that extend outside the vertical box formed by a fabric compartment, thereby preventing tipping of the enclosure. The fabric compartment of the enclosure is tightly fitted to the corner posts of the frame members allowing a side support rod to be inserted in the upper side rails of the enclosure preventing downward side flex. The corners of the fabric compartment are covered at the top edge by a fabric panel that prevents a child from standing up in the corner. When the enclosure is rectangular, the frame is stabilized along the short axis by a separator rod that prevents the short axis from collapsing. The rectangular frame type enclosure also includes a U-shaped end pieces that provide further support along the end.

These together with other objects and advantages which will be subsequently apparent, reside in the details of construction and operation as more fully hereinafter described and claimed, reference being had to the accompanying drawings forming a part hereof wherein like numerals refer to like parts throughout.

DESCRIPTION OF THE PREFERRED EMBODIMENTS

Figure 1:
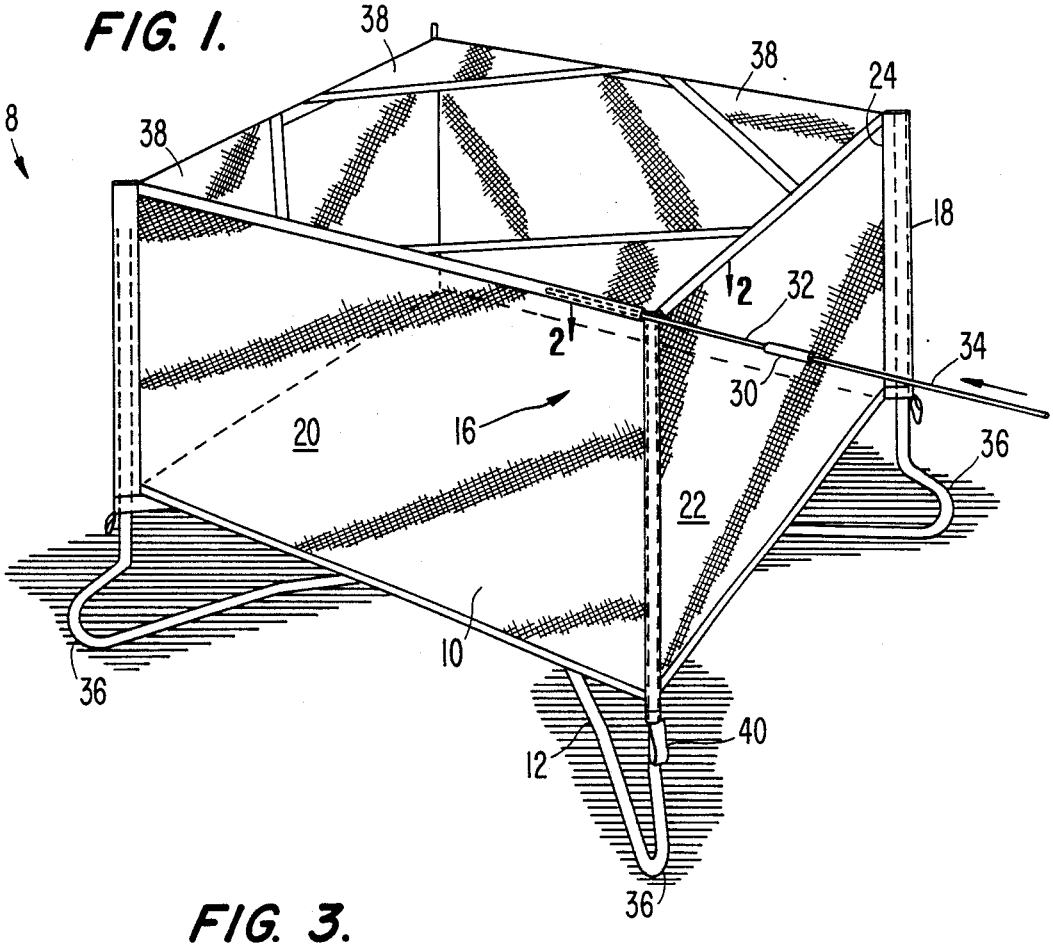
FIG. 1 is a perspective view of a child playpen type enclosure 8 in accordance with the present invention.

A child enclosure 8 in accordance with the present invention includes a fabric compartment 10 and a frame 12. The details of construction and materials of the fabric compartment 10 and of the frame 12 are set forth in U.S. Pat. No. 4,538,309 which is incorporated by reference herein. The present invention improves over the playpen described in the above identified patent by providing an easily insertable side rail support rod 14. The rod 14 prevents a child from flexing the fabric side panels downward, thereby preventing a particularly strong or advanced child from climbing or falling out. Each corner 16 of the enclosure 8 is constructed so that the upright support 18 of the frame 12 is in very close proximity to the adjacent side panels 20 and 22 of the fabric compartment 10. The upright support tube 24 tightly fits or is closely spaced from the upright support 18 so that the inward spaced relationship of the sides 20 and 22 with respect to the support is designed to be as small as possible. The support 18 directly supports the tube 24 rather than an inward spaced relationship type support.

Figure 2:
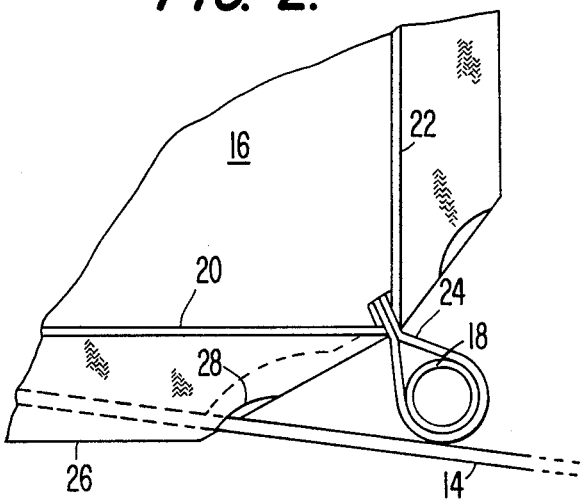
FIG. 2 illustrates the details of a corner 16 of the enclosure.

The corner 16 is illustrated in more detail in FIG. 2. Each side includes an upper rail side pocket 26 with a slit 28 through which the rod 14 is inserted. The arrangement allows the rod 14 to be inserted into the side rail pocket 26 after the enclosure 8 is assembled. That is, after the fabric compartment 10 is fitted over frame 12 rod insertion is relatively easy. This is in contrast to the prior art playpen in which the inward offset of the fabric compartment from the frame produced by the enlarged upright sleeve prevents easy insertion of a side rod after the fabric compartment 10 is on the frame 12 and allows the excessive flex previously mentioned. The close spaced support provided by the small diameter tube 24 also provides increased support to the compartment 10. By providing the tube 24 very close to the sides 20 and 22 and thus very close to the rod 14 after insertion, the side flex force on rod 14 is efficiently transferred to the upright 18 and to the adjacent sides preventing the excessive flex.

Returning to FIG. 1, the rod 14 includes a coupler 30 and two joinable sections 32 and 34. The ability to take the rod 14 apart enhances the portability of the enclosure 8 allowing all the pieces of the enclosure 8 to fit into a carrying case which can be carried by a strap over the shoulder. A further improvement in stability in the enclosure is provided over the prior art by the J-shaped sections 36 of the frame 12. The J-shaped sections 36 extend outward beyond the horizontal footprint of the fabric compartment 10 increasing the stability of the enclosure when a child is vigorously moving around in a compartment 10. An additional safety related feature is corner covers 38 which are fabric panels sewn to the top edges of the side rail compartments 26 as illustrated in FIG. 1. The panels 38 prevent a child from standing in the corner of the enclosure 8 where it is easier to rock the enclosure 8 by rapid movements. The panel 38 also helps stabilize the side rails by providing support from the adjacent side panels further preventing flex. The corner covers 38 also transfer some of the force on each side to nonadjacent corners, thereby spreading the weight more evenly on the corner posts 18. The weight spreading increases the useful life of the enclosure 8 because the maximum punch through force on the upper ends of support tubes 24 is reduced. The fitting of the compartment 10 over the frame 12 is made easier by the provision of a pull down strap 40 through which a finger can be inserted to aid in sliding the tube 24 over the upright sections 18.

Figure 3:
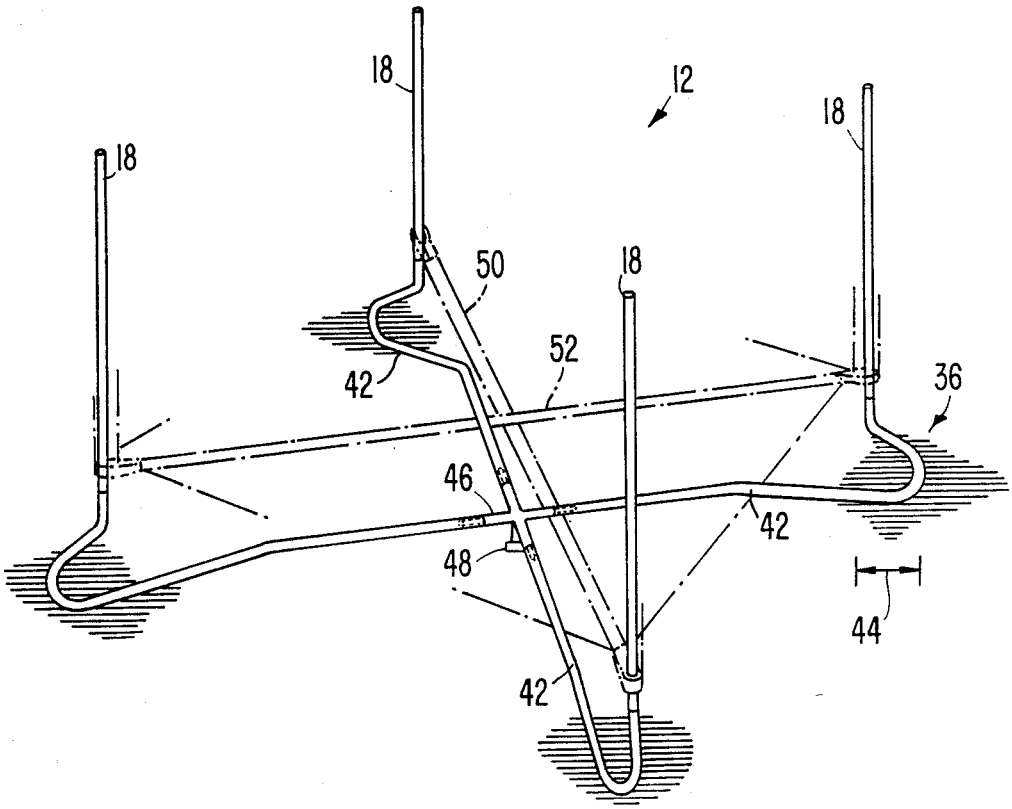
FIG. 3 illustrates the disassemblable frame 12 and bottom, support structure of the present invention in more detail.

FIG. 3 illustrates the frame 12 in more detail. The frame includes the upright tubular sections 18 and J-shaped base members 42. The distance 44 by which each J-shaped section 36 extends beyond the position of the corresponding upright corner post 18 should be at least six inches to prevent tipping and to increase stability. The base members 42 are coupled by a connector 46, the details of which are described in U.S. application Ser. No. 771,046 incorporated by reference herein. The connector 46 includes a stopper 48 that helps prevent the enclosure from sliding around on hard surfaces. The connector 46 is a non-locking, slip-on type connector and the frame is held against the connector by the compression force of compartment bottom support straps 50 and 52. These straps 50 and 52 not only support the bottom of the compartment 10, but also provide the compressive force which holds the frame 12 in coupling attachment to the connector 46.

Figure 4:
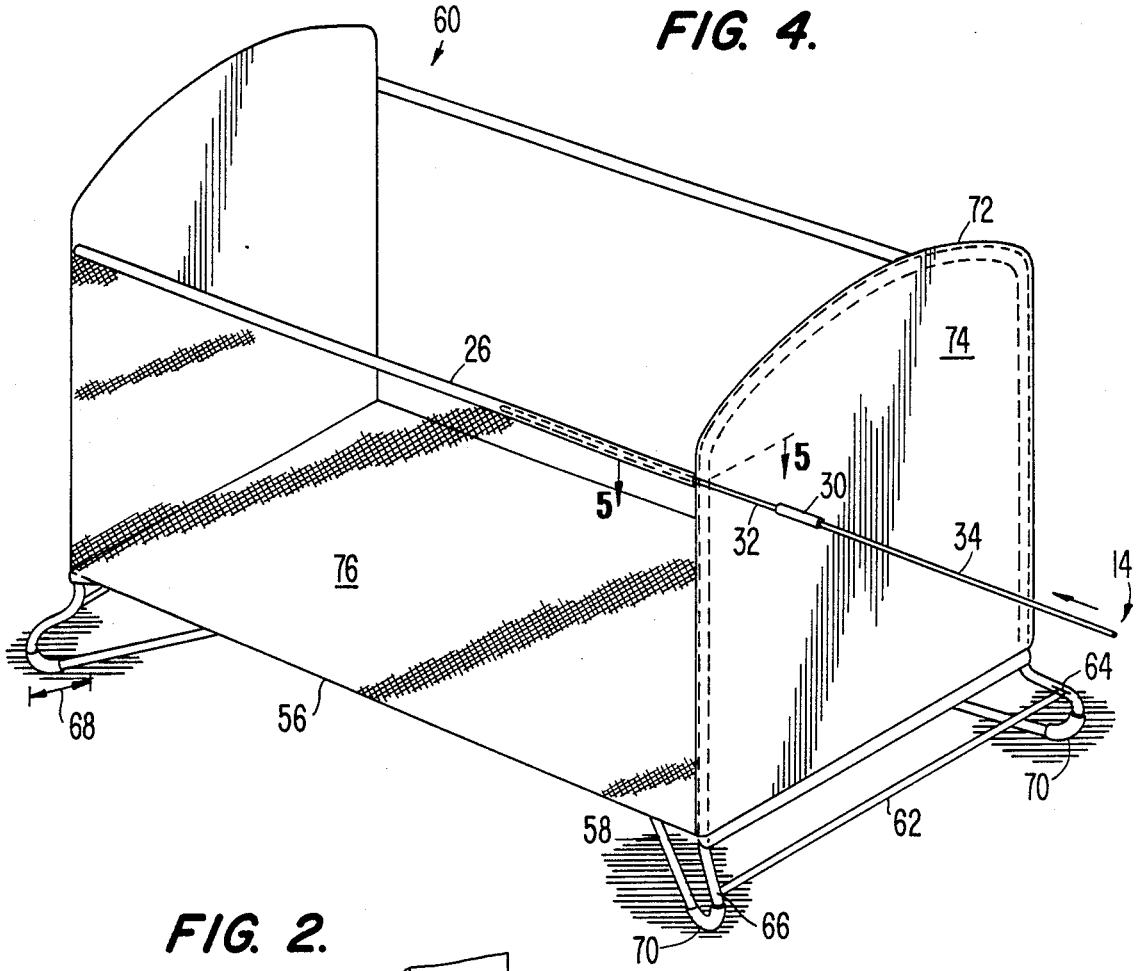
FIG. 4 illustrates a baby bed type enclosure 60 in accordance with the present invention.

FIG. 4 illustrates another embodiment of the child enclosure 8 which is a rectangular shaped crib 60. Because the frame, illustrated in FIG. 4, is X-shaped rather than cross-shaped, as in the embodiment of FIG. 1, an increased amount of force is applied to the short axis of the frame 58 during use. To prevent the short axis of the frame 58 from becoming unstable due to inward flexing. A crossbar support 62 is provided which fits in slots 64 and 66 in the J-shaped portion of the frame 12. This support 62 is aluminum for its lightweight. The distance 68 by which the J-shaped section of the frame extends beyond the corner of the rectangular enclosure should be approximately six inches. To prevent the crib 60 from sliding about on a hard surface, snap-on, slip prevention rubber tubes 70 with a slit in one side to allow fitting over the J-shaped sections of the frame 58 can be provided.

Figure 5:
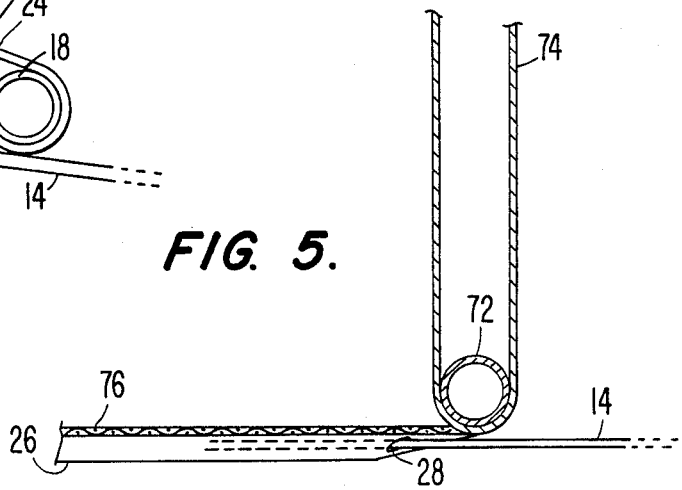
FIG. 5 illustrates the relationship of the upright corner posts 72 and the fabric compartment 26 in which a side support rod 14 resides.

FIG. 5 illustrates the side panel of the crib 60 in greater detail. The end panel 74 is a single, very large pocket over which the U-shaped end frame 72 fits. The upper side rail of the rectangular enclosure 60 includes a side rail pocket 26 and slit 28 through which the side support rod 14 can be inserted. Because the fabric for the side panel 76 is positioned on the outside of the frame members 72, the insertion of rod 14 into pocket 26 is made even easier. Once again, the side rod 14 provides increased side panel stability for the enclosure 60 because of the close support provided to the pocket.

Figure 6:
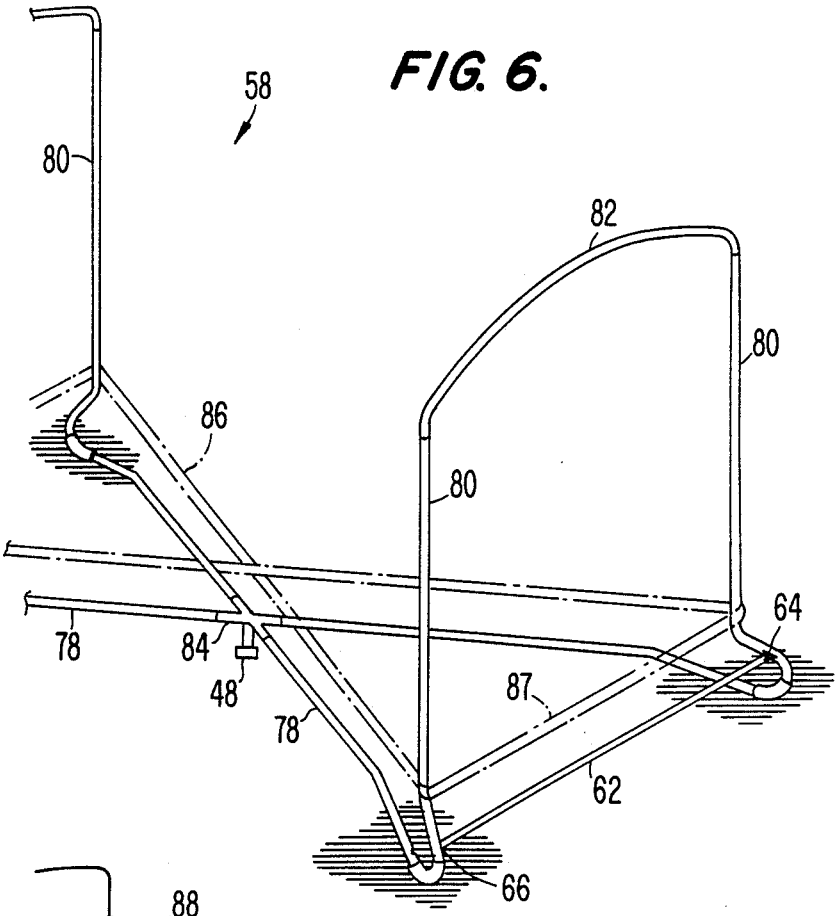
FIG. 6 illustrates the frame 58 of the rectangular enclosure 60 in more detail.

FIG. 6 illustrates the frame 58 of the crib 60 in more detail. The frame 58 not only includes J-shaped base members 78 and uprights 80, but also a U-shaped end support member 82 which provides increased strength to the short axis of the enclosure 60. The end support member 82 not only supports the compartment 56, but because it does not have any relatively sharp upwardly projecting edges, enhances the life expectancy of the fabric compartment 56 by reducing wear. The connector 84 of the enclosure 60 is X-shaped rather than cross-shaped as in the embodiment of FIG. 2. To keep the end rod 62 coupled to the slots 64 and 66 on the short axis of the enclosure 60, a bottom support strap 86 which loops around the end of the frame 58 as provided forming end strap 87. The end strap 87 and support strap 86 not only keep the rod 62 in compression, but also support the bottom of the fabric compartment 56.

Figure 7:
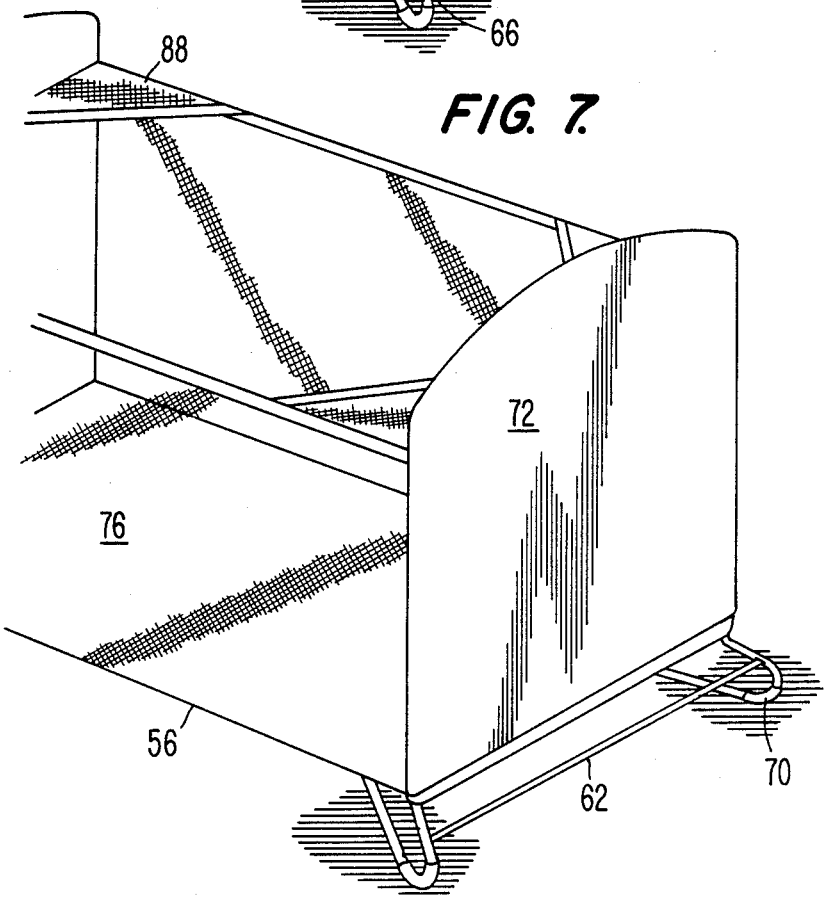
FIG. 7 illustrates a further embodiment of the rectangular enclosure 60.

FIG. 7 illustrates the enclosure 60 with corner covers 88 which once again prevent a child from standing up in the corner of the enclosure 60 and rocking it about.

The many features and advantages of the invention are apparent from the detailed specification and thus, it is intended by the appended claims to cover all such features and advantages of the invention which fill within the true spirit and scope thereof. Further, since numerous modifications and changes will readily occur to those skilled in the art, it is not desired to limit the invention to the exact construction and operation illustrated and described, and accordingly, all suitable modifications and equivalents may be resorted to, falling within the scope of the invention.

What I claim is:

1. A portable child enclosure, comprising:

a dissassemblable base frame including stabilization means for preventing tipping of the enclosure;

upright detachable corner posts coupled to said base frame;

a fabric compartment with corner post tubes sealed at the top and closely supported by said upright detachable corner posts, said compartment defining a space for containing the child;

corner covering means overhanging the space and for preventing a child from climbing out of said compartment; and wherein said stabilization means comprises J-shaped frame members extending exterior of the fabric compartment, wherein said fabric compartment includes side support means for supporting top edges of the sides of said compartment, and wherein said fabric compartment has an upper edge compartment running between said corner posts along the top edge of said compartment and said side support means comprises an insertable side rail inserted in said upper edge compartment and closely supported by said corner posts.

2. An enclosure as recited in claim 1, wherein said corner covering means comprises a fabric panel attached to adjacent sides at the top of each side.

* * * * *